US010122100B1

(12) United States Patent
Reeves

(10) Patent No.: US 10,122,100 B1
(45) Date of Patent: Nov. 6, 2018

(54) TERMINAL BLOCK ASSEMBLIES

(71) Applicant: Lee Reeves, Amarillo, TX (US)

(72) Inventor: Lee Reeves, Amarillo, TX (US)

( * ) Notice: Subject to any disclaimer, the term of this patent is extended or adjusted under 35 U.S.C. 154(b) by 0 days.

(21) Appl. No.: 15/923,533

(22) Filed: Mar. 16, 2018

(51) Int. Cl.
*H01R 9/24* (2006.01)

(52) U.S. Cl.
CPC ..... *H01R 9/2491* (2013.01); *H01R 9/2475* (2013.01)

(58) Field of Classification Search
CPC ..... H01R 9/2491; H01R 9/2475
USPC ..... 439/189, 76.2, 507–510, 607.3, 607.27, 439/607.34
See application file for complete search history.

(56) References Cited

U.S. PATENT DOCUMENTS 3,518,611 A * 6/1970 Shores, Jr. ..... H04Q 1/142 361/627
3,541,494 A * 11/1970 Berg Quentin ..... H01R 13/193 439/189
3,787,749 A * 1/1974 Uchida ..... G01R 13/32 315/360
3,912,885 A * 10/1975 Koster ..... G01R 31/023 379/25
3,936,133 A * 2/1976 Splitt ..... H01T 4/06 361/824
3,947,732 A * 3/1976 Cwirzen ..... H04Q 1/142 361/824
4,171,861 A * 10/1979 Hohorst ..... H01R 4/4845 439/49
4,927,787 A * 5/1990 Patel ..... H01H 27/04 200/506
5,044,962 A * 9/1991 Tomes ..... H01R 9/28 439/108
5,116,241 A * 5/1992 Sato ..... H01R 31/08 439/49
5,285,011 A * 2/1994 Shimochi ..... H01H 85/2035 174/138 F
5,669,788 A * 9/1997 Brockman ..... H01R 9/2675 439/511
5,859,580 A * 1/1999 Hashizawa ..... H01H 85/56 337/255
6,111,758 A * 8/2000 Dowd ..... H05K 7/103 174/541
6,196,858 B1 * 3/2001 Matsumoto ..... H01H 9/085 335/132
6,196,862 B1 * 3/2001 Dooley ..... H01R 4/2433 361/119
7,223,117 B2 5/2007 Pratt
7,331,814 B2 2/2008 Pratt
7,883,362 B2 * 2/2011 Ichio ..... H01R 13/40 439/511
8,979,577 B2 * 3/2015 Wu ..... H01R 13/05 439/507
9,058,752 B2 6/2015 Ganster et al.
9,059,533 B2 6/2015 Bogart et al.
(Continued)

*Primary Examiner* — Harshad C Patel
(74) *Attorney, Agent, or Firm* — The Elliott Law Firm, PLLC; Douglas H. Elliott; Nathan Q. Huynh

(57) ABSTRACT

The disclosure herein includes a terminal block assembly, which terminal block assembly may include: a terminal block; and a tag removably coupled to the terminal block, wherein the tag includes: a body having an upper surface and a lower surface; a tab extending from the upper surface of the body; and a pin having a first end that is tapered, the pin extending from the lower surface of the body.

2 Claims, 2 Drawing Sheets

(56) References Cited

U.S. PATENT DOCUMENTS

| | | | | |
|---|---|---|---|---|
| 9,093,762 | B2 | 7/2015 | Schwarzkopf et al. | |
| 2008/0261426 | A1* | 10/2008 | Diekmann | H01H 85/2045 439/189 |
| 2010/0046195 | A1* | 2/2010 | Ostmeier | H01R 13/7032 361/823 |

* cited by examiner

TERMINAL BLOCK ASSEMBLIES

BACKGROUND

1. Field of Inventions

The field of this application and any resulting patent is terminal block assemblies.

2. Description of Related Art

Various terminal block assemblies and methods for tagging terminal blocks have been proposed and utilized, including some of the methods and structures disclosed in the references appearing on the face of this patent. However, those methods and structures lack the combination of steps and/or features of the methods and/or structures covered by the patent claims below. Furthermore, it is contemplated that the methods and/or structures covered by at least some of the claims of this issued patent solve many of the problems that prior art methods and structures have failed to solve. Also, the methods and/or structures covered by at least some of the claims of this patent have benefits that would be surprising and unexpected to a hypothetical person of ordinary skill with knowledge of the prior art existing as of the filing date of this application.

SUMMARY

The disclosure herein includes a terminal block assembly, which terminal block assembly may include: a terminal block; and a tag removably coupled to the terminal block, wherein the tag includes: a body having an upper surface and a lower surface; a tab extending from the upper surface of the body; and a pin having a first end that is tapered, the pin extending from the lower surface of the body.

The disclosure herein includes a tag configured for removable coupling to a terminal block, which tag may include: a body having an upper surface and a lower surface; a tab extending from the upper surface of the body; and a pin having a first end that is tapered, the pin extending from the lower surface of the body.

The disclosure herein includes a method of marking a terminal block having a receptacle, the method may include: providing a tag that includes: a body having an upper surface and a lower surface; a tab extending from the upper surface of the body; and a pin having a tapered end, the pin extending from the lower surface of the body; and extending a portion of the pin into the receptacle of the terminal block.

DETAILED DESCRIPTION

1. Introduction

Figure 1:
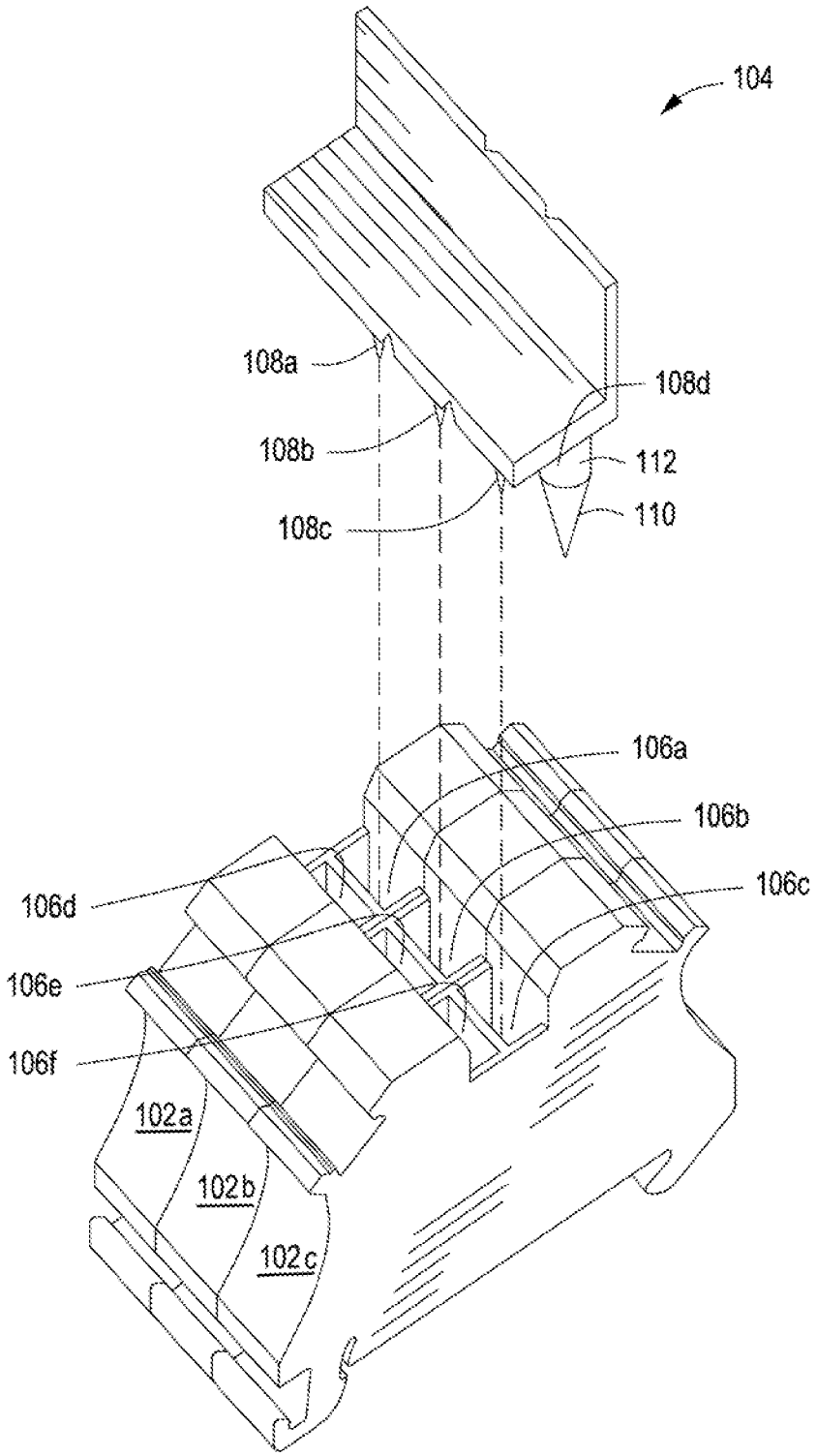
FIG. 1 illustrates a perspective view of terminal block assembly that includes a tag and a plurality of terminal blocks.

A detailed description will now be provided. The purpose of this detailed description, which includes the drawings, is to satisfy the statutory requirements of 35 U.S.C. § 112. For example, the detailed description includes a description of inventions defined by the claims and sufficient information that would enable a person having ordinary skill in the art to make and use the inventions. In the figures, like elements are generally indicated by like reference numerals regardless of the view or figure in which the elements appear. The figures are intended to assist the description and to provide a visual representation of certain aspects of the subject matter described herein. The figures are not all necessarily drawn to scale, nor do they show all the structural details nor do they limit the scope of the claims.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology. Various terms as used herein are defined below, and the definitions should be adopted when construing the claims that include those terms, except to the extent a different meaning is given within the specification or in express representations to the Patent and Trademark Office (PTO). To the extent a term used in a claim is not defined below or in representations to the PTO, it should be given the broadest definition persons having skill in the art have given that term as reflected in at least one printed publication, dictionary, or issued patent.

2. Selected Definitions

Certain claims include one or more of the following terms which, as used herein, are expressly defined below.

The term "aligning" as used herein is defined as a verb that means manufacturing, forming, adjusting, or arranging one or more physical objects into a particular position. After any aligning takes place, the objects may be fully or partially "aligned." Aligning preferably involves arranging a structure or surface of a structure in linear relation to another structure or surface; for example, such that their borders or perimeters may share a set of parallel tangential lines. Additionally, a plurality of jumper apertures of a terminal block may be aligned in a row. In certain instances, the aligned borders or perimeters may share a similar profile.

The term "aperture" as used herein is defined as any opening in a solid object or structure. For example, an aperture may be an opening that begins on one side of the solid object and ends on the other side of the object. An aperture may be round. An aperture may be polygonal-shaped, e.g., triangular, square, rectangular, pentagonal, hexagonal. An aperture may alternatively be an opening that does not pass entirely through the object, but only partially passes through, e.g., a groove. An aperture can be an opening in an object that is completely circumscribed, defined, or delimited by the object itself. Alternatively, an aperture can be an opening in the object formed when the object is combined with one or more other objects or structures. An aperture may be disposed in and passed entirely through a structure, e.g., terminal block. An aperture may receive another object and permit ingress and/or egress of the object through the aperture. Thus, a pin of a tag may be received in a jumper aperture of a terminal block.

The term "assembly" as used herein is defined as any set of components that have been fully or partially assembled together. A group of assemblies may be coupled to form a structure having an inner surface and an outer surface.

The term "body" as used herein is defined as any wall, structure, or assembly having a planar surface. A body may be a rectangular prism having sides that may be parallel to one another. A body may be solid. A body may have one or more grooves disposed therein. A portion of a body is capable of being detached, e.g., broken off, torn off, or removed, at a groove.

The term "coupled" as used herein is defined as directly or indirectly connected, attached, or integral with, e.g., part of. A first object may be coupled to a second object such that the first object is positioned at a specific location and orientation with respect to the second object. For example, two shorter shaft assemblies may be coupled to form a longer shaft assembly. A first object may be either permanently or removably coupled to a second object. Two objects may be permanently coupled to each other via adhesive or welding; or they may be removably coupled via screws, nuts and bolts, or press fit. For example, a tag may be removably coupled to a terminal block such that the tag may then be uncoupled and removed from the terminal block. A pin of a tag may be inserted into a jumper aperture of a terminal block and may be removably coupled to the terminal block such that the pin may then be uncoupled and removed from the terminal block. A pin of a tag may be inserted into a jumper aperture of a terminal block such that the outer surface of the pin is abutted against an inner surface of the terminal block that defines the jumper aperture. A pin may have an outer surface having a diameter that is longer than a length between opposing points of an inner surface of a terminal block that defines a jumper aperture. Thus, the pin would be coupled to the terminal block if the pin were inserted into the jumper aperture of the terminal block and the outer surface of the pin were to be abutted against the inner surface of the terminal block.

The term "cylindrical" as used herein is defined as shaped like a cylinder, e.g., having straight parallel sides and a circular or oval or elliptical cross-section. A cylindrical body or structure, e.g., a pin, may be completely or partially shaped like a cylinder. A cylindrical body, e.g., a pin, that has an outer diameter that changes abruptly may have a radial face or "groove" (see, e.g., 206, FIGS. 2-3) extending toward the center axis line. A cylindrical body may have an aperture that extends through the entire length of the body to form a hollow cylinder. On the other hand, a cylindrical structure may be solid, e.g., rod or peg. A pin of a tag is an example of a solid cylindrical body.

The term "groove" as used herein is defined as an indentation in a surface. A groove may extend in a straight line from one end to another. A groove may be a continuous loop, e.g., around a cylindrical structure. A groove may extend in a meandering path from end to another, e.g., a S-shaped or C-shaped path. A groove may have a cross-section that is V-shaped. A groove may have a cross-section that is rectangular. A groove may have a cross-section that is arcuate, e.g., U-shaped. A groove disposed in a body may be adjacent to a groove disposed in a tab. A groove disposed in a body may be connected to a groove disposed in a tab to form one continuous groove.

The term "marking" as used herein is defined as a noun that means a visual indicium. A marking may include characters, e.g., letters, numbers, pictures, and/or symbols. A marking may be one or more written, drawn and/or printed characters. A marking may be a label having characters disposed thereon. A marking may be disposed on, coupled to, affixed to, or etched in a body of a tag. A marking may be disposed on, coupled to, affixed to, or etched in a tab of a tag.

The term "pin" as used herein is defined as a structure that may be removably coupled to a terminal block. A pin may have a center axis line that is perpendicular, e.g., orthogonal or tangential, to a body of a tag. A pin may have an end that is tapered, e.g., conical. A pin may have an end that is frustoconical. A pin may have an end that is cylindrical. A pin may have a groove disposed circumferentially therein. A portion of a pin is capable of being detached, e.g., broken off, torn off, or removed, at a groove.

The term "surface" as used herein is defined as any face of a structure. A surface may refer to that flat or substantially flat area that is planar which may, for example, be part of a body or tab of a tag. A surface may refer to that flat or substantially flat area that extends radially around a cylinder which may, for example, be part of a pin. A surface may also refer to that flat or substantially flat area that extend radially within a structure to define a circular-shaped aperture therein which may, for example, be part of a terminal block. A surface may also refer to that flat or substantially flat area that extend continuously within a structure to define a polygonal-shaped aperture therein which may, for example, be part of a terminal block. A surface may have irregular contours. A surface may be formed from components, e.g., a body, a tab, and a pin, coupled together. Coupled components may form irregular surfaces.

The term "tab" as used herein is defined as a structure connected to a body of a tag. A tab may be planar. A tab may have a plane that is perpendicular, e.g., orthogonal or tangential, to a body of a tag. A tab and body of tag may form a shape of a block letter "L". A tab may be disposed at an end of a body of a tag. A tab may have a thickness less than that of a body of a tag. A tab may have one or more grooves disposed therein. A portion of a tab is capable of being detached, e.g., broken off, torn off, or removed, at a groove.

The term "tag" as used herein is defined as a structure that is capable of being coupled to another structure, e.g., a terminal block. A tag may include a body, a tab, and one or more pins. The tag may be formed, e.g., by molding or by carving, from a single piece of material, e.g., plastic, ceramic, metal, or wood. Thus, a body, a tab, and one or more pins of a tag may be integral with, e.g., part of, each other. On a tag, a pin may be disposed on a side of a body and a tab may be disposed on an opposite side of the body. On a tag, a pin and a tab may be disposed on the same end of a body. A tag may have as few as 1, 2, or 3 pins and as many as 4, 5, 6, 7, 8, 9, 10, 11, 12, or even more pins.

The term "terminal block" as used herein is defined as a structure that is capable of being coupled to one or more electrical wires. A terminal block may include a continuous surface that defines a jumper aperture therein. A terminal block may have one or more jumper apertures disposed therein. A terminal block may be removably coupled to a tag. A terminal block may be removably coupled to a jumper.

3. Certain Specific Embodiments

The disclosure herein includes a terminal block assembly, which terminal block assembly may include: a terminal block; and a tag removably coupled to the terminal block, wherein the tag includes: a body having an upper surface and a lower surface; a tab extending from the upper surface of the body; and a pin having a first end that is tapered, the pin extending from the lower surface of the body.

The disclosure herein includes a tag configured for removable coupling to a terminal block, which tag may include: a body having an upper surface and a lower surface; a tab extending from the upper surface of the body; and a pin having a first end that is tapered, the pin extending from the lower surface of the body.

The disclosure herein includes a method of marking a terminal block having a receptacle, the method may include: providing a tag that includes: a body having an upper surface and a lower surface; a tab extending from the upper surface of the body; and a pin having a tapered end, the pin extending from the lower surface of the body; and extending a portion of the pin into the receptacle of the terminal block.

In any one of the methods or structures disclosed herein, the pin may have a groove disposed circumferentially therein.

In any one of the methods or structures disclosed herein, the body may have a groove disposed therein.

In any one of the methods or structures disclosed herein, wherein the tab has a groove disposed therein.

In any one of the methods or structures disclosed herein, the body may have a first groove disposed therein and the tab may have a second groove disposed therein, wherein the first groove may be connected to the second groove.

In any one of the methods or structures disclosed herein, the first end of the pin further includes a conical tip.

In any one of the methods or structures disclosed herein, the first end of the pin further may include a frustoconical tip.

In any one of the methods or structures disclosed herein, the pin may have a second end configured for removable coupling to the terminal block.

In any one of the methods or structures disclosed herein, the terminal block may have a jumper receptacle capable of receiving the pin.

In any one of the methods or structures disclosed herein, the terminal block may have a jumper receptacle configured for removable coupling to the pin.

In any one of the methods or structures disclosed herein, the body may have opposing planar surfaces.

In any one of the methods or structures disclosed herein, the tab may have opposing planar surfaces.

In any one of the methods or structures disclosed herein, the tab and the body may form an L-shape.

In any one of the methods or structures disclosed herein, the tab may be orthogonal to the body.

In any one of the methods or structures disclosed herein, the pin may be orthogonal to the body.

In any one of the methods or structures disclosed herein, the tab and pin may extend in opposite directions from the body.

In any one of the methods or structures disclosed herein, the tab may extend away from terminal block.

In any one of the methods or structures disclosed herein, the pin may extend towards the terminal block.

In any one of the methods or structures disclosed herein, the body may have a first thickness and the tab may have a second thickness, wherein the first thickness of the body may be greater than second thickness of the tab.

Any one of the methods or structures disclosed herein may further include breaking the pin at a groove disposed in the pin.

Any one of the methods or structures disclosed herein may further include breaking the body at a groove disposed in the body.

Any one of the methods or structures disclosed herein may further include breaking the tab at a groove disposed in the tab.

Any one of the methods or structures disclosed herein may further include: breaking the body at a groove disposed in the body; and breaking the tab at groove disposed in the tab, wherein the groove disposed in the body may be connected to the groove disposed in the tab.

Any one of the methods or structures disclosed herein may further include affixing a marking on the body.

Any one of the methods or structures disclosed herein may further include affixing a marking on the tab.

4. Specific Embodiments in the Drawings

The drawings presented herein are for illustrative purposes only and do not limit the scope of the claims. Rather, the drawings are intended to help enable one having ordinary skill in the art to make and use the claimed inventions.

This section addresses specific versions of tags for terminal blocks shown in the drawings, which relate to assemblies, elements and parts that can be part of a tag, and methods for removably coupling elements and parts of such tags to terminal blocks. Although this section focuses on the drawings herein, and the specific embodiments found in those drawings, parts of this section may also have applicability to other embodiments not shown in the drawings. The limitations referenced in this section should not be used to limit the scope of the claims themselves, which have broader applicability.

Although the methods, structures, elements, and parts described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims, while the description, abstract and drawings are not to be used to limit the scope of the invention. The invention is specifically intended to be as broad as the claims below and their equivalents.

FIG. 1 illustrates a perspective view of terminal block assembly for use in an electrical hardware system. The terminal block assembly may include a tag 104 and a plurality of terminal blocks 102*a-c*. The tag 104 may be removably coupled to the terminal blocks 102*a-c*. Depending on operating requirements of each electrical hardware system, various circuit connections may be established via terminal blocks. One or more electrical wires (not shown) may be coupled to each terminal block 102. Each wire may be coupled to a conductive assembly (not shown) disposed in a jumper aperture 106 of a terminal block 102. A jumper, e.g., plug-in bridge, (not shown) may be inserted into two or more jumper apertures 106 to establish a circuit connection.

For example, a circuit connection between terminal blocks 102*a-c* is established once a jumper is inserted into a row of aligned jumper apertures 106 of the terminal blocks 102*a-c*. The circuit connection may be tagged so workers can properly identify the circuit connection for later work. The circuit connection may be tagged, e.g., labelled or marked, by coupling the tag 104 to the terminal blocks 102*a-c*, as shown in FIG. 1, Preferably, each terminal block 102 is a feed-through terminal block. Each terminal block 102 may include one or more jumper apertures 106 disposed therein. Each jumper aperture 106 may receive a pin 108 of the tag 104. Additionally, each jumper aperture 106 may receive a portion, e.g., a conductive prong, of a jumper (not shown).

Each pin 108 may be configured for removable coupling to a terminal block 102. For example, each pin 108 may include a first end 110 and a second end 112. As shown in FIG. 1, the first end 110 of each pin 108 may be tapered and may also have a tip that is conical or more preferably frustoconical. The second end 112 of each pin 108 may be cylindrical. Also, the second end 112 of each pin 108 may have an outer surface having a diameter that is slightly larger than a length, width, or diameter of a continuous surface that defines each jumper aperture 106 of a terminal block 102. Thus, if each pin 108 is inserted into a corresponding jumper aperture 106, the outer surface of the pin 108 is abutted against the continuous surface of the terminal block 102 that defines the corresponding jumper aperture 106. Friction between the outer surface of the second portion 112 of each pin 108 and the continuous surface of the terminal block 102 may prevent the tag 104 from slipping out of the terminal block 102.

Although FIG. 1 illustrates a tag 104 for coupling to a plurality of terminal blocks 102*a-c*, in other cases, a tag 104 may have one or more pins 108 coupled to only one terminal block 102. For instance, a tag 104 may have two pins 108 for respective coupling to the jumper apertures 106*a*, 106*d* of the terminal block 102*a*.

Figure 2:
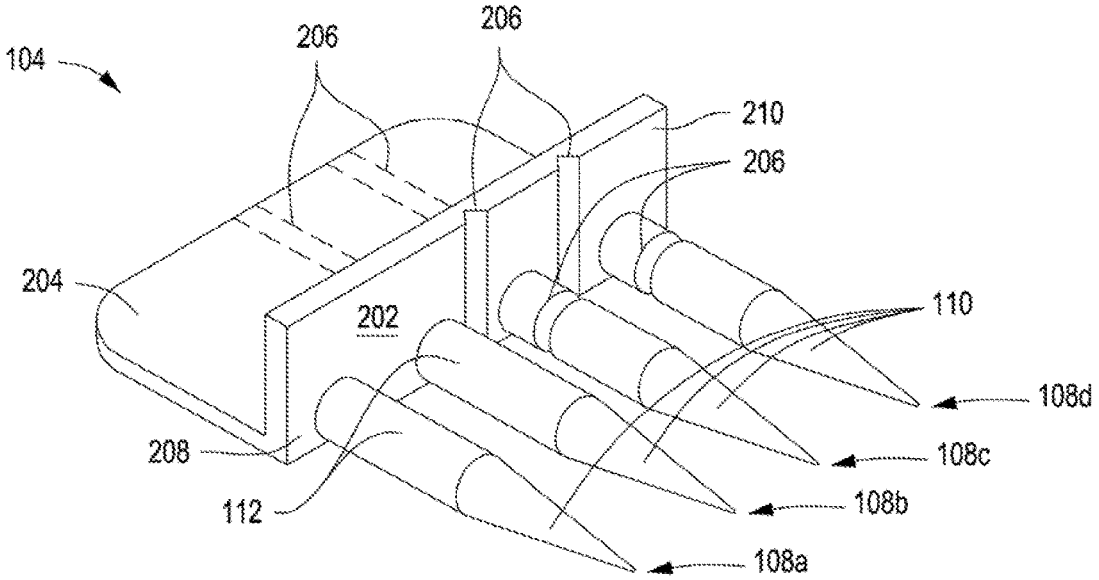
FIG. 2 illustrates a perspective view of a tag.

FIG. 2 illustrates a perspective view of a tag 104. The tag 104 includes a body 202, a tab 204, and one or more pins 108. The tab 104 may be formed, e.g., by molding or by carving, from a single piece of material, e.g., plastic, ceramic, metal, or wood, or from multiple pieces coupled together. Preferably, however, the body 202, the tab 204, and the one or more pins 108 are integral with each other and are all part of the tag.

The body 104 may be a rectangular prism having an upper surface 212, a lower surface 214, a first end 208, and second end 210. The upper surface 212 of the body 104 may be adapted to receive one or more markings.

Additionally, grooves 206 may be disposed in the body 202. The grooves 206 may be disposed in the lower surface 214 of the body 202. Furthermore, the grooves may extend from the first end 208 to the second end 210 of the body 202. Portions of the body 202 having grooves 206 may be thinner than other portions of the body 202 that have no grooves. Thus, a portion of the body 202 is capable of being detached, e.g., broken off, torn off, or removed, at each groove 206.

As shown in FIG. 2, the tab 204 may extend from the upper surface 212 of the body 202. The tab 204 may extend from an end, e.g., the first end 208 or the second end 210, of the body 202. Additionally, the tab 204 may be perpendicular, e.g., orthogonal or tangential, to the body 202.

Also, grooves 206 may be disposed in the tab 204. The grooves 206 may be disposed on one side, e.g., the back side, of the tab 204, as indicated by the dash-lines in FIG. 2. A portion of the tab 202 having a groove 206 may be thinner than other portions of the tab 202 that have no grooves. Thus, a portion of the tab 204 is capable of being detached, e.g., broken off, torn off, or removed, at each groove 206.

Figure 3:
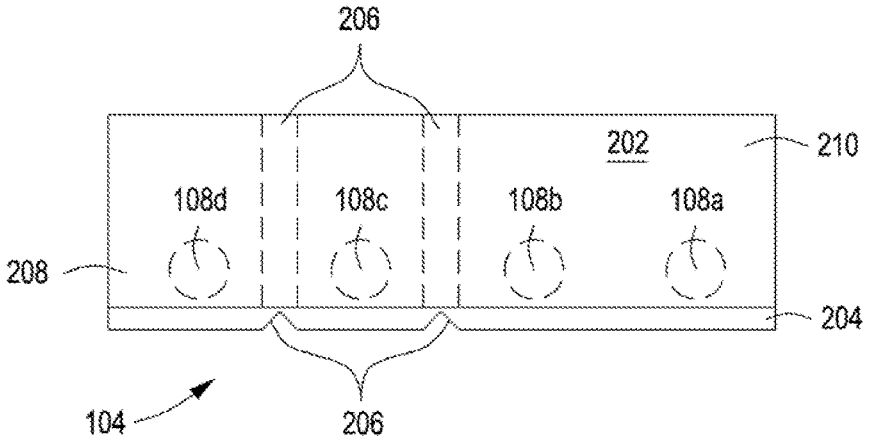
FIG. 3 illustrates a top plan view of a tag.

Furthermore, each groove 206 in the tab 204 may be connected or adjacent to a groove 206 in the body 202 (see FIG. 3). Thus, a portion of the body 202 and a portion of the tab 204 is capable of being detached, e.g., broken off, torn off, or removed, at connected or adjacent grooves 206.

Still referring to FIG. 2, one or more pins 108 may extend from the lower surface 214 of the body 202. Each pin 108 may extend from an end, e.g., the first end 208 or the second end 210, of the body 202. Additionally, a center axis line of each pin 108 may be perpendicular to the body 202.

Also, a groove 206 may be disposed circumferentially around the outer surface of each pin 108. A portion of each pin 108 having a groove 206 may be thinner than other portions of the pin 108 that have no groove. Thus, a portion of a pin 202 is capable of being detached, e.g., broken off, tom off, or removed, at a groove 206.

As shown in FIG. 2, a groove 206 may be disposed in the body 202, between each pair of pins 108. Thus, a portion of the body 202, a portion of the tab 204, and a pin 108 are capable of being detached, e.g., broken off, torn off, or removed, at connected grooves 206.

FIG. 3 illustrates a top plan view of a tag 104 in which only the upper surface 212 of the body 202 and the tab 204 are visible. Dash-lines indicate grooves 206 and pins 108 on the lower side 214 (FIG. 2) of the body 202. As shown in FIG. 3, the tab 204 and the pins 108 may be disposed on one side, e.g., the second side 210, of the body 202.

Referring to FIG. 1 and FIG. 2, a circuit connection may be established by inserting a jumper (not shown) into first row of three aligned jumper apertures 106*d-f*. The jumper may have three jumper pins (not shown). The jumper pins may be electrical conductors for establishing a circuit connection between the terminal blocks 102.

Accordingly, the tag 104 may be used to identify the circuit connection. The pins 108*a-c* of the tag 104 may be inserted in a second row of aligned jumper apertures 106*a-c* of the terminal block 102, as shown in FIG. 1. Although, the tag 104 has four pins 108*a-d*, only three pins 108*a-c* may be insert into the corresponding jumper apertures 106*a-c*. Therefore, a worker may break and remove the unused pin 108*d* at the groove 206 disposed in the surface of the pin 108*d* (FIG. 2).

Alternatively, the worker may break and remove a portion of the tag 102 which has the pin 108*d*. The worker may break off a portion of the body 202 along the groove 206 disposed between the pin 108*c* and pin 108*d*. Additionally, the worker may break off a portion of the tab 204 along the groove 206 that is connected to the groove 206 of the body 202 disposed between the pin 108*c* and pin 108*d*. Thus, the length of the tag 104 may be adapted to span any number of jumper apertures 106.

Additionally, the worker may couple, affix, or etch a marking to the upper surface 212 of the body 202 of the tag 104. Furthermore, the worker may couple, affix, or etch a marking to the tab 204 of the tag 104.

What is claimed as the invention is:

1. A terminal block assembly comprising:

a terminal block; and a tag removably coupled to the terminal block, wherein the tag comprises:

a body having an upper surface and a lower surface;

a tab extending from the upper surface of the body; and a pin consisting of plastic, ceramic, or wood and having a first end that is tapered and a groove disposed circumferentially therein, the pin extending from the lower surface of the body, wherein a portion of the pin is detachable at the groove.

2. A terminal block assembly comprising:

a terminal block; and a tag removably coupled to the terminal block, wherein the tag comprises:

a body having an upper surface, a lower surface, and a groove disposed therein;

a tab extending from the upper surface of the body, the tab having a groove disposed therein; and a pin consisting of plastic, ceramic, or wood and having a first end that is tapered, the pin extending from the lower surface of the body;

wherein a portion of the body is detachable at the groove of the body and a portion of the tab is detachable at the groove of the tab.

* * * * *